United States Patent [19]

Fassler

[11] 4,365,380

[45] Dec. 28, 1982

[54] BRUSH-LIKE CLEANING TOOL FOR CLEANING GRILLS AND OTHER STRUCTURES HAVING ELONGATE ROD-LIKE MEMBERS

[76] Inventor: Fred G. Fassler, 7 Oreca Ter., Monroe, N.Y. 10954

[21] Appl. No.: 86,349

[22] Filed: Oct. 19, 1979

Related U.S. Application Data

[63] Continuation-in-part of Ser. No. 951,648, Oct. 16, 1978, abandoned.

[51] Int. Cl.[3] ..... A47L 17/00

[52] U.S. Cl. ..... 15/111; 15/104.04; 15/236 R

[58] Field of Search ..... 15/104.04, 111, 236 R, 15/236 C, 167 A; 30/169, 172; D4/6, 8, 12

[56] References Cited

U.S. PATENT DOCUMENTS

| | | | |
|---|---|---|---|
| 1,355,574 | 10/1920 | Ryberg | 15/104.04 |
| 1,692,911 | 11/1928 | Vaughn | 15/236 R |
| 2,244,615 | 6/1941 | Garcin | 15/167 A |
| 2,443,602 | 6/1948 | Clark | 15/236 R X |
| 2,807,814 | 10/1957 | Leeming | 15/111 |
| 2,824,323 | 2/1958 | Tos et al. | 15/111 X |
| 3,310,826 | 3/1967 | Ellis | 15/236 R X |
| 3,487,491 | 1/1970 | Dunn | 15/111 |
| 3,719,993 | 3/1973 | Caprioli | 15/104.04 X |

FOREIGN PATENT DOCUMENTS

| | | | |
|---|---|---|---|
| 745 | of 1886 | United Kingdom | 15/167 A |

*Primary Examiner*—Edward L. Roberts

*Attorney, Agent, or Firm*—Morgan, Finnegan, Pine, Foley & Lee

[57] ABSTRACT

A cleaning tool includes a tool body having a scraper member formed at the front end of the tool body, the scraper having a generally circular scraping edge which projects outwardly from the bottom surface of the tool body and is proportioned generally to surround rod-like members of the structure to be cleaned when in use. As preferably embodied, the tool head further includes at least one row of short bristles affixed to its bottom surface and two rows of generally longer bristles extending parallel to and located on both sides of the row(s) of short bristles.

10 Claims, 5 Drawing Figures

BRUSH-LIKE CLEANING TOOL FOR CLEANING GRILLS AND OTHER STRUCTURES HAVING ELONGATE ROD-LIKE MEMBERS

CROSS REFERENCE TO RELATED APPLICATION

This application is a continuation-in-part of my copending application Ser. No. 951,648, filed Oct. 16, 1978, now abandoned.

BACKGROUND AND OBJECTS OF THE INVENTION

The present invention relates generally to cleaning tools for cleaning cooking grills and similar structures formed with elongate rod-like members and more particularly to combination brush/scrapers for cleaning such devices.

The art is replete with various arrangements and configurations of brushes, scrapers and tools having a brush and scraper affixed to the same handle. Known brushes vary in size and shape, as well as in the size(s), shape(s), arrangement and material make-up of the brush bristles in accordance with the particular intended use for the brush. Most scrapers have a flat scraping edge, but some are formed with one or more notches for special applications.

For purposes of cleaning cooking grills and other structures made up of elongate rod-members, various types of brush and scraping tools have been developed for removing burned foods, fats or other encrusted substances from the rods. In general, these tools incorporate a wire-bristle brush member affixed to one side or end of a brush handle and a scraper or similar blade-like member mounted to an opposite end or side. Examples of such devices are U.S. Pat. No. 3,487,491 to Dunn and U.S. Pat. No. 2,807,814 to Leeming. Although these devices may be adequate for certain applications, they suffer several marked drawbacks.

First, the brush and scraper must be used separately. Thus, after the person has loosened some encrusted material with the scraper, he must turn the tool over or around in order to brush that material off the structure. This process usually must be repeated several times before cleaning is complete.

In addition, as indicated above, the scrapers on such tools have either a flat scraping edge or, at best, are formed with one or more notch-like recesses to fit around a portion of the rods. Thus, when used for cleaning a cooking grill, it is difficult, if not impossible, to scrape the sides and bottom portions of the grill rods, particularly with a flat-edge scraper, unless the grill is lifted which is usually impossible when the grill is hot. Similarly, it is difficult, if not impossible, for the brush bristles to clean the sides and bottom portions of the grill rods.

Accordingly, it is an object of the present invention to provide a new and improved cleaning tool for cleaning cooking grills and other similar structures having rod-like members. It is also an object of the invention to provide a new and improved cleaning tool for cleaning encrusted material from grills and the like, which includes a scraping means in cooperative operative relation with brush bristles to permit simultaneous scraping and brushing action on the rod-like members.

Another object of the invention is to provide a cleaning tool for cleaning cooking and barbecue grills and like structures, which includes scraping means capable of easily scraping encrusted materials from virtually all surfaces of the component rod members without having to move the grill or engage in contortious manipulations of the tool. Also, the invention is intended to provide a cleaning tool which does not have to be reserved or otherwise re-oriented in order to change from a brushing action to a scraping action.

It is a further object of the present invention to provide a new and improved cleaning tool for cleaning grills and the like, which is relatively simple and fast to use, and which permits efficient cleaning effort to save time and labor. In addition, the present invention is intended to permit quick and efficient cleaning of cooking grills in, for example, commercial diners or quick-food establishments where the grill is in virtually constant use and burned foods and fats accumulate rapidly. This will encourage more frequent use to provide a cleaner cooked product and less chance of a flash fire occuring due to the igniting of accumulated foods on the grill.

Objects and advantages of the invention are set forth in part herein and in part will be appreciated herefrom. These and other objects and advantages may be learned through practice with the invention, the same being realized and attained by means of the structures, instrumentalities and combinations pointed out in the appended claims. Accordingly, the invention resides in the novel parts, constructions, arrangements, combinations and improvements herein shown and described.

SUMMARY OF THE INVENTION

Briefly described, the cleaning tool according to the present invention includes a tool body having scraper means mounted to the front end thereof, the scraper means including an open-ended generally cylindrical scraping member which projects outwardly of the bottom surface of the tool body and which is open along a portion of its side to provide an almost circular scraping edge which is discontinuous at said opening to permit a rod to pass within the cylinder-like structure. A plurality of wire-like brush bristles are affixed to the tool body and project outwardly from its bottom surface.

As preferably embodied, the brush bristles include at least one row of generally short brush bristles extending longitudinally back of the scraper and at least two rows of longer brush bristles extending parallel to and on both sides of said one row of short bristles. Also as preferably embodied, the longer brush bristles flare slightly outwardly in the direction away from the bottom of the tool body.

It will be apparent from the foregoing general description that the objects and advantages of the invention specifically enumerated herein are achieved by the invention as herein embodied. Thus, for example, it will be found that the present invention provides a cleaning tool for cleaning elongate rod-like members, which incorporates a new scraper device and brush configuration. This cleaning tool permits relatively easy and thorough cleaning of encrusted materials on the elongate rod members of a grill or like structure.

By providing two rows of long brush bristles surrounding one or more rows of shorter bristles and converging towards each other, it will be found that the brush bristles can reach the top and most of the side portions of rod-like members to facilitate cleaning same. In addition, by incorporating the cylinder-like scraper means which projects in the same direction as the brush bristles, it will be found that the rod-like members can be cleaned by simultaneous and cooperative brushing and scraping action of one cleaning tool. Moreover, the tool does not have to be reversed or re-oriented in order to scrape and then brush the rod-like members, or vice versa.

By providing scraping means which include a generally circular scraping edge, it will be found that virtually all surfaces of the rod-like members can be cleaned by a simple back-and-forth stroke of the tool without requiring the grill to be lifted or otherwise moved and without requiring the tool to be forced between pairs of rods or otherwise manipulated to reach inaccessible surfaces.

It will also be found that the brush-like cleaning tool according to the invention enables fast and thorough cleaning of grill rods and the like, encouraging more frequent use for cleaner grill and less chances of a flash fire occurring.

It will be understood that the foregoing general description as well as the following detailed description are exemplary and explanatory of the invention but are not intended to be restrictive thereof.

The accompanying drawings, referred to herein and constituting a part hereof, illustrate preferred embodiments of the invention and, together with the description, serve to explain the principles of the invention.

DETAILED DESCRIPTION OF A PREFERRED EMBODIMENT

Referring now more particularly to the embodiment of the invention illustrated in the accompanying drawings, there is illustrated a brush-like cleaning tool for cleaning grills or like structures made up generally of elongate rod-like members (hereinafter, "rod members").

Figure 1:
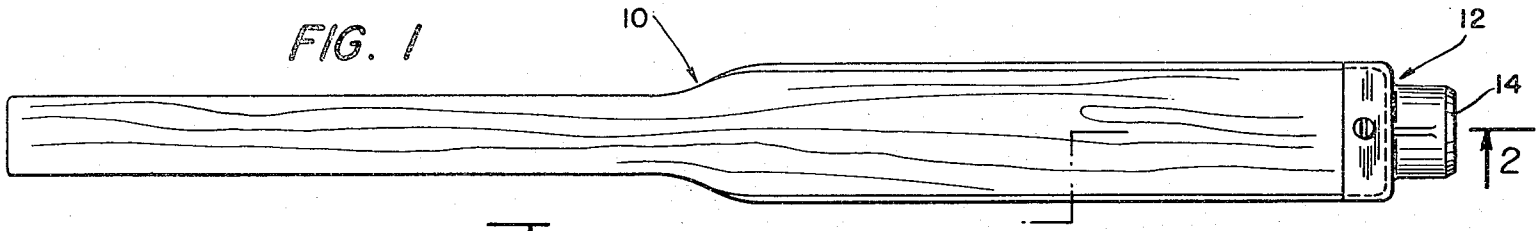
FIG. 1 is a plan view of the top of an embodiment of the cleaning tool according to the present invention.

As here embodied, the cleaning tool of the present invention includes brush portion 10 and scraper portion 12. Brush portion 10 is made up of handle section **10*a* and body section 10*b* which are preferably integrally formed together of a relatively strong and thermally insulating material such as wood or plastic. Scraper 12 is preferably affixed to the front end of body portion 10*b* (i.e., the end opposite that on which the handle is formed) by suitable fastening means, such as screws. (See FIGS. 1 and 3**)

Figure 2:
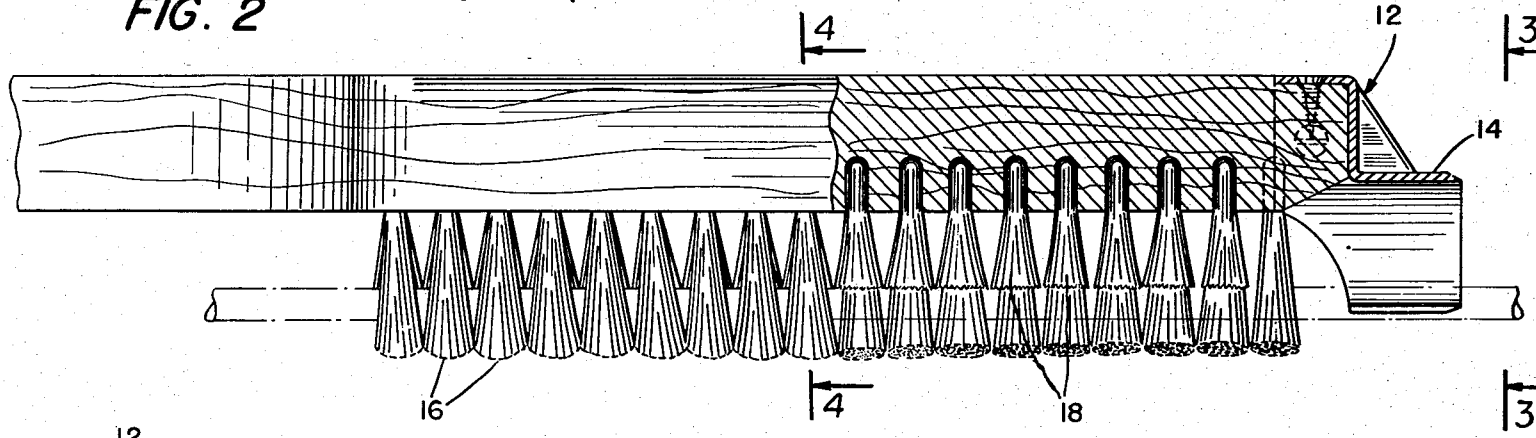
FIG. 2 is a side view of the cleaning tool shown in FIG. 1, part in elevation and part in section, as indicated by section lines 2—2 of FIG. 1, including a rod-like member in position to be cleaned.
Figure 4:
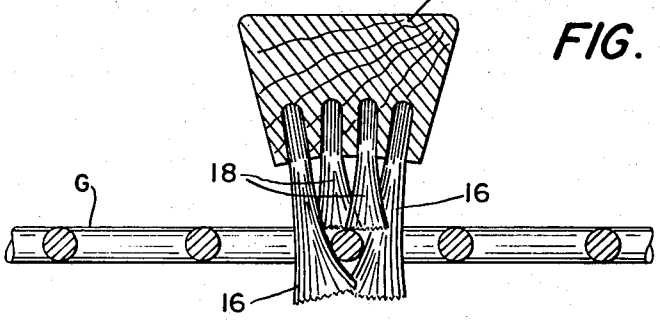
FIG. 4 is a section view of the cleaning tool shown in FIGS. 1 and 2, taken along section lines 4—4 in FIG. 2.
Figure 3:
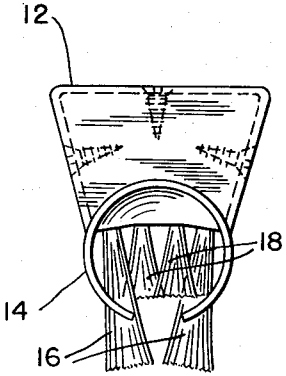
FIG. 3 is an end view of the cleaning tool shown in FIGS. 1 and 2, as viewed along section lines 3—3 of FIG. 2.

Referring more particularly to FIGS. 2-4, a plurality of brush bristles (indicated by reference numbers 16 and 18) are affixed to brush body **10*b* so as to project from one surface portion (hereinafter, the "bottom"). There are preferably at least two lengths of brush bristles. Short bristles 18, extending approximately one-half inch ($\frac{1}{2}$") from the bottom surface of the brush, are affixed to brush body 10*b* in at least one row (and preferably two rows) extending generally longitudinally of the brush portion. The longer bristles 16 (approximately $\frac{3}{4}$" to 1" in length) are formed in at least two rows extending parallel to and located on both sides of the row(s) of short bristles 18**.

Bristles 16 and 18 are preferably made of a strong, stiffly resilient and heat resistant material such as commonly used in so-called wire brushes. Also, the bristles may be affixed to the brush body in any conventional matter adapted to provide secure attachment, such as by embedding doubled-over bristle strands in holes drilled or otherwise formed in the brush body. The brush bristles, especially bristles 16, are arranged with each group thereof flaring outwardly so that some of the bristles almost touch, or do in fact touch, each other, as best shown in FIGS. 3 and 4.

In addition, the bottom surface of the brush is formed slightly concave so that, while the base portions of the bristles are perpendicular to a tangent to the concave surface where attached, the ends of bristles 16 generally define a plane which is slightly inclined inwardly with respect to the plane defined by the ends of bristles 18. Alternatively, the brush bottom may be flat and each row of bristles 16 can be embedded in the brush body so as to be inclined slightly inwardly toward bristles 18. In this way, simultaneous brushing action can be achieved by the ends of all the bristles.

As preferably embodied, scraper 12 includes a generally cylindrical scraper member 14, open at both of its ends and formed with a slot-like opening extending the entire length of its bottom side as indicated at **14*a* in FIG. 3. The front facing edge 14*b* of scraping member 14 is preferably beveled, as best shown in FIG. 2, to provide a relatively sharp scraping edge which is generally circular in configuration. The back facing edge of member 14** can also be beveled to provide a second scraping edge for dual scraping action in operation.

The mounting portion of scraper 12 (indicated at 15) is preferably adapted to encase a portion of the front end of brush body **10*b*. In this way, scraper 12 can be securely attached to brush member 10, as by threaded fasteners secured from three sides (FIG. 3). In addition, reinforcing rib 14*c* can be formed between mounting bracket portion 15 and scraper portion 14** to rigidify the scraper which is made of steel or other metal.

In operation, and referring particularly to FIG. 4, the cleaning tool is moved over the rod-like member (indicated generally at G in FIG. 4) to be cleaned, with slot-like opening **14*a* extending parallel to the rod. The person then positions the scraper so that the rod is situated within the cylindrical scraper 14 and the tool is moved back-and-forth in the direction of the rod while urging some portion of scraping edge 14*b* against the rod. Because scraper cylinder 14 is cylindrical and scraping edge 14*b* is circular (actually, it is C-shaped with a small opening), the person can simply and easily urge some portion of scraper edge 14*b* against every surface portion of the rod, including its bottom surface. All the person has to do is simply change the direction in which he urges the scraper 14 against the rod. To reach the bottom of the rod, the person need only rotate the tool about the rod so that the rod will not pass out through slot 14*a*** when the person urges the scraper upwardly against the bottom of the rod.

After a sufficient amount of scraping action has been completed, the tool is oriented so that brush bristles 18 touch the top surface of the rod. The tool is again moved back-and-forth along the rod and the short bristles 18 provide a brushing action against the top portion of the side. At the same time, the longer bristles 16 develop a brushing action against most of the side portions of the rod. If the tool is rotated about the rod, virtually every surface of the rod can be subjected to a brushing action.

Thus, it will be readily appreciated that the rod member can be easily and thoroughly cleaned by a combination of scraping and brushing action achieved by using a single cleaning tool. Moreover, such cleaning is achieved through a simple back-and-forth movement, without any need to reverse or turn over the tool.

It is to be understood that slot-like opening 14*a* can be formed at locations on cylindrical member 14 other than at its bottom. Thus, the opening need only be dimensioned as wide as or slightly wider than the rod member to be cleaned in order to permit the rod to pass within the cylinder (usually about $\frac{1}{4}''$ to $\frac{3}{8}''$). However, with the opening at the bottom, it may be easier for a person to align the slot with the rod during use. For ease of use, the opening preferably extends in a direction parallel to the longitudinal axis of the cylinder.

It will also be understood that the tool body 10*b* can be formed to any convenient shape and size. As here embodied, the cross-sectional configuration of the tool body is slightly trapezoidal (FIGS. 3 and 4) and can be about one inch (1") wide along the top surface and about three-quarters of an inch ($\frac{3}{4}''$) wide along the bottom surface, shown slightly concave.

In addition, scraper 14 may be formed from a single sheet-like piece of steel or other metal. The sheet will be stamped to have three tab-like portions which are folded back (relative to a central portion which abuts the front facing end edge of the tool body) to form the top and two sides of the attaching portion 15 through which the three screws are inserted for securing the scraper to the tool body. The sheet will also include a fourth tab-like member which is folded relative to the central portion and then bent to form the desired configuration of the scraper edge 14*b*—i.e., a round or square-like scraper, etc. When so integrally formed from a single sheet of metal, the scraper will not have reinforcing rib 14*c*. However, by selecting sufficiently strong metal, the rib may not be necessary. Of course, for exceptionally heavy duty use where substantial scraping force can be expected, rib 14*c* can simply be welded or soldered onto scraper 14.

Figure 5:
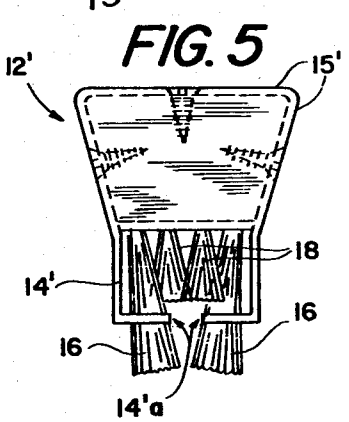
FIG. 5 is a view, similar to FIG. 3, of another embodiment of the cleaning tool according to the present invention.

FIG. 5 shows an alternate embodiment with a scraper 12' made up of attaching portion 15' and square-like scraper 14' defining rod-receiving slot 14*a*'.

The great ease and the thoroughness with which this cleaning tool permits cleaning the rods of a grill will encourage the user to use the device more frequently to keep the grill clean, thereby reducing the chances of a flash fire due to accumulated facts, grease, etc., as well as providing cleaner conditions for cooking.

Those skilled in the art will appreciate that the invention in its broader aspect is not limited to the specific embodiment herein shown and described. For example, scraper member 12 can be adapted for use on structures having flat surfaces, such as wrought iron railings used on porches and steps. The cross-sectional configuration of scraper member 14 would, however, have to include straight portions or may even be square-like in shape (with an opening similar to opening 14*a*) instead of the circular configuration shown in FIG. 3. The brush bristles need not be modified, as they can be applied against surfaces having round, flat or other contours.

Thus, it will be appreciated that variations may be made therefrom, which are within the scope and spirit of the invention as defined in the accompanying claims, without departing from the principles of the invention or sacrificing its chief advantages.

What is claimed:

1. A cleaning tool for cleaning cooking grills or like structures made of of rod-like members, comprising:

a relatively elongate single-piece tool body adapted to be gripped in a person's hand and having a bottom surface;

scraper means formed generally at an end of said tool body and providing a scraper edge extending generally below the bottom surface of said tool body, said scraper edge being a permanent structure in the form of an almost-closed-loop two-dimensional figure and said scraper means having an opening proportioned to permit a rod-like member to pass through said opening and become generally encircled within said scraper edge; and a plurality of brush bristles affixed to the bottom surface of said tool body and extending generally in the same direction as said scraper edge, such that when the rod-like member is generally encircled within said scraper edge, the person can apply a scraping action against virtually the entire surface of the rod-like member simply by changing the direction in which he urges the tool body against the rod-like member and, if need be, rotating the tool body slightly about the rod-like member, permitting said tool to be used to apply both a scraping action and a brushing action to the rod-like member without requiring the tool to be reoriented or turned over.

2. A cleaning tool for cleaning cooking grills or like structures made up of rod-like members, comprising:

a tool body adapted to be gripped in a person's hand and having a bottom surface;

scraper means formed generally at an end of said tool body and providing a scraper edge projecting generally outwardly from the bottom surface of said tool body, said scraper edge being in the form of an almost-closed two-dimensional figure and said scraper means having an opening proportioned to permit a rod-like member to pass through said opening and become generally encircled within said scraper edge; and a plurality of brush bristles affixed to the bottom surface of said tool body and extending generally in the same direction as said scraper edge, such that when the rod-like member is encircled within said scraper edge, the person can apply a scraping action against virtually the entire surface of the rod-like member simply by changing the direction in which he urges the tool body against the rod-like member and, if need be, rotating the tool body slightly about the rod-like member, permitting said tool to be used to apply both a scraping action and a brushing action to the rod-like member without requiring the tool to be reversed or turned over.

3. A cleaning tool according to claim 2, wherein said plurality of brush bristles include:

at least one row of first brush bristles extending generally longitudinally of the tool body, generally in the center thereof; and at least two rows of second brush bristles extending generally parallel to said first row, said rows of second brush bristles being located on both sides of all said rows of first bristles, said second bristles being longer than said first bristles, such that when said tool is used for applying a brushing action to the rod member, several portions of the rod can be brushed simultaneously.

4. A cleaning tool according to claims 1 or 3, wherein said scraper means includes a generally cylindrical member located generally outwardly of said bottom surface, with its longitudinal axis extending generally parallel to said bottom surface, said scraper edge being formed on at least one end of said cylindrical member which has a slot-like opening in a portion of its side wall to permit entry of the rod member within the cylindrical member.

5. A cleaning tool according to claim 4, wherein said cylindrical member is generally round in cross-section to define a generally circular scraper edge.

6. A cleaning tool according to claim 1 or 3, wherein said scraper means comprises a scraper member defined by a sidewall which is generally square-like in cross-section to define a generally square-like scraper edge on at least one end of said scraper member sidewall which has an opening therein to permit entry of the rod member within the cylindrical member.

7. A cleaning tool according to claim 3, which includes two of said rows of first bristles.

8. A cleaning tool according to claim 7, wherein each said row of said second bristles is inclined towards the other.

9. A cleaning tool according to claim 3, wherein each said row of said second bristles is inclined toward the other.

10. A cleaning tool according to claims 3, 4, 9 or 8, wherein said first bristles do not extend outwardly from the bottom surface of said tool body beyond said scraper edge while said second bristles extend beyond said scraper edge.

* * * * *